US011414633B2

(12) United States Patent
Bird et al.

(10) Patent No.: US 11,414,633 B2
(45) Date of Patent: Aug. 16, 2022

(54) CLEANING METHOD, APPARATUS AND USE

(71) Applicant: Xeros Limited, Rotherham (GB)

(72) Inventors: Robert Andrew Bird, Rotherham (GB); Stephen Derek Jenkins, Rotherham (GB); Philipp Kloke, Mannheim (DE); Simon Kniesel, Weinheim (DE); Shyam Sathyanarayana, Mannheim (DE); Martina Schoemer, Ludwigshafen (DE)

(73) Assignee: Xeros Limited, Rotherham (GB)

( * ) Notice: Subject to any disclaimer, the term of this patent is extended or adjusted under 35 U.S.C. 154(b) by 88 days.

(21) Appl. No.: 15/748,234

(22) PCT Filed: Jul. 28, 2016

(86) PCT No.: PCT/GB2016/052314
§ 371 (c)(1),
(2) Date: Jan. 29, 2018

(87) PCT Pub. No.: WO2017/017455
PCT Pub. Date: Feb. 2, 2017

(65) Prior Publication Data

US 2018/0216049 A1 Aug. 2, 2018

(30) Foreign Application Priority Data

Jul. 29, 2015 (GB) ..... 1513346.5

(51) Int. Cl.

| | |
|---|---|
| ***C11D 11/00*** | (2006.01) |
| ***C11D 3/37*** | (2006.01) |
| ***D06F 35/00*** | (2006.01) |
| ***D06B 3/30*** | (2006.01) |
| ***C11D 1/22*** | (2006.01) |
| ***C11D 3/00*** | (2006.01) |
| ***C11D 3/14*** | (2006.01) |

(52) U.S. Cl.
CPC ..... *C11D 11/0017* (2013.01); *C11D 1/22* (2013.01); *C11D 3/0021* (2013.01); *C11D 3/3707* (2013.01); *C11D 3/3719* (2013.01); *D06B 3/30* (2013.01); *D06F 35/00* (2013.01); *C11D 3/14* (2013.01)

(58) Field of Classification Search
CPC ..... C11D 11/0017; C11D 3/0021; C11D 3/14; C11D 3/3707; C11D 3/3719; C11D 1/22; D06F 35/00; D06B 3/30
See application file for complete search history.

(56) References Cited

U.S. PATENT DOCUMENTS

| | | | |
|---|---|---|---|
| 8,959,961 | B2 | 2/2015 | Jenkins et al. |
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,455 | B2 | 12/2017 | Jenkins et al. |
| 9,850,619 | B2 | 12/2017 | Wells et al. |
| 9,914,901 | B2 | 3/2018 | Burkinshaw et al. |
| 9,932,700 | B2 | 4/2018 | Wells et al. |
| 10,017,895 | B2 | 7/2018 | Wells et al. |
| 10,081,900 | B2 | 9/2018 | Wells et al. |
| 10,287,642 | B2 | 5/2019 | Scott |
| 10,301,691 | B2 | 5/2019 | Feyisa et al. |
| 10,316,448 | B2 | 6/2019 | He et al. |

(Continued)

FOREIGN PATENT DOCUMENTS

| | | |
|---|---|---|
| CN | 102061588 A | 5/2011 |
| CN | 102061589 A | 5/2011 |

(Continued)

OTHER PUBLICATIONS

U.S. Appl. No. 15/578,306, Sawford et al.
U.S. Appl. No. 15/737,407, Steele et al.
U.S. Appl. No. 15/863,062, Wells et al.
International Search Report and Written Opinion for International Application No. PCT/GB/2016/052314, dated Nov. 11, 2016 (11 pages).
U.S. Appl. No. 16/481,583, Xeros Ltd.
U.S. Appl. No. 16/497,070, Xeros Ltd.
Liu et al., "New Hydrogel for Controlled Release of Triclosan and its Antibacterial Activity," Chinese Medical Device Information, 1006-6586(2015)04-0050-04 (4 pages).
U.S. Appl. No. 17/258,396, Xeros Ltd.
U.S. Appl. No. 17/258,406, Xeros Ltd.
U.S. Appl. No. 17/280,519, Xeros Ltd.

*Primary Examiner* — Amina S Khan
(74) *Attorney, Agent, or Firm* — Clark & Elbing LLP

(57) ABSTRACT

A method for cleaning a substrate which is or comprises a textile, the method comprising agitating the substrate and a cleaning composition comprising: i. cleaning particles comprising a thermoplastic polyamide and a hydrophilic material at least part of which is located inside the cleaning particle, said cleaning particles having an average particle size of from 1 to 100 mm; and ii. a liquid medium. An apparatus suitable for performing said method comprising a rotatable cleaning chamber and a particle storage tank containing the cleaning particles. Use of the cleaning particles for cleaning a substrate which is or comprises a textile.

28 Claims, No Drawings

(56) References Cited

U.S. PATENT DOCUMENTS

| | | | | |
|---|---|---|---|---|
| 10,494,590 | B2 | 12/2019 | Abercrombie et al. | |
| 10,590,499 | B2 | 3/2020 | Ashfaq et al. | |
| 10,597,814 | B2 | 3/2020 | Wells et al. | |
| 10,865,364 | B2 | 12/2020 | Kniesel et al. | |
| 2009/0186798 | A1* | 7/2009 | Baston | C11D 3/0021 510/360 |
| 2011/0296628 | A1 | 12/2011 | Jenkins et al. | |
| 2012/0048299 | A1 | 3/2012 | Jenkins et al. | |
| 2013/0167882 | A1 | 7/2013 | Burkinshaw et al. | |
| 2013/0276242 | A1* | 10/2013 | Jenkins | D06F 35/006 8/137 |
| 2014/0201929 | A1 | 7/2014 | He et al. | |
| 2014/0317860 | A1 | 10/2014 | He et al. | |
| 2015/0027173 | A1 | 1/2015 | Wu et al. | |
| 2015/0096128 | A1 | 4/2015 | Sawford et al. | |
| 2015/0128358 | A1 | 5/2015 | Wells et al. | |
| 2015/0152357 | A1 | 6/2015 | Abercrombie et al. | |
| 2015/0175945 | A1 | 6/2015 | Waddon et al. | |
| 2015/0252511 | A1 | 9/2015 | Roberts et al. | |
| 2016/0040260 | A1 | 2/2016 | Steele | |
| 2016/0122936 | A1 | 5/2016 | Wells et al. | |
| 2016/0195409 | A1 | 7/2016 | Goldberg et al. | |
| 2016/0197998 | A1 | 7/2016 | Carleo | |
| 2016/0251602 | A1 | 9/2016 | Steele et al. | |
| 2016/0251603 | A1 | 9/2016 | Steele et al. | |
| 2017/0051447 | A1 | 2/2017 | He et al. | |
| 2017/0137983 | A1 | 5/2017 | He et al. | |
| 2017/0159222 | A1 | 6/2017 | Jenkins et al. | |
| 2017/0240980 | A1 | 8/2017 | Feyisa et al. | |
| 2017/0240981 | A1 | 8/2017 | Scott | |
| 2017/0240982 | A1 | 8/2017 | Sadeghi | |
| 2017/0241061 | A1 | 8/2017 | Wells et al. | |
| 2017/0247771 | A1 | 8/2017 | Scott | |
| 2017/0267949 | A1 | 9/2017 | Bird et al. | |
| 2018/0057777 | A1 | 3/2018 | Waddon et al. | |
| 2018/0127914 | A1 | 5/2018 | Wells et al. | |
| 2018/0134994 | A1 | 5/2018 | Steele et al. | |
| 2018/0141089 | A1 | 5/2018 | Sawford et al. | |
| 2019/0144959 | A1 | 5/2019 | Ashfaq et al. | |
| 2019/0210892 | A1 | 7/2019 | Scott et al. | |
| 2019/0211288 | A1 | 7/2019 | Potts et al. | |
| 2019/0233760 | A1 | 8/2019 | Lavery et al. | |
| 2020/0002650 | A1 | 1/2020 | Servin et al. | |
| 2021/0179979 | A1 | 6/2021 | Servin et al. | |

FOREIGN PATENT DOCUMENTS

| | | | | | |
|---|---|---|---|---|---|
| CN | 202175862 | U | | 3/2012 | |
| CN | 102425053 | A | | 4/2012 | |
| CN | 102425055 | A | | 4/2012 | |
| CN | 202214631 | U | | 5/2012 | |
| CN | 202214633 | U | | 5/2012 | |
| CN | 202298219 | U | | 7/2012 | |
| CN | 202298220 | U | | 7/2012 | |
| CN | 202298222 | U | | 7/2012 | |
| CN | 202323458 | U | | 7/2012 | |
| CN | 202359387 | U | | 8/2012 | |
| CN | 202359388 | U | | 8/2012 | |
| CN | 202359389 | U | | 8/2012 | |
| CN | 202359390 | U | | 8/2012 | |
| CN | 202359396 | U | | 8/2012 | |
| CN | 202492706 | U | | 10/2012 | |
| CN | 202543634 | U | | 11/2012 | |
| CN | 202543635 | U | | 11/2012 | |
| CN | 202543646 | U | | 11/2012 | |
| CN | 202543652 | U | | 11/2012 | |
| CN | 102899848 | A | | 1/2013 | |
| CN | 202688698 | U | | 1/2013 | |
| CN | 202755220 | U | | 2/2013 | |
| CN | 202755221 | U | | 2/2013 | |
| CN | 102953249 | A | | 3/2013 | |
| CN | 102953250 | A | | 3/2013 | |
| CN | 102953262 | A | | 3/2013 | |
| CN | 102978870 | A | | 3/2013 | |
| CN | 103061084 | A | | 4/2013 | |
| CN | 103061085 | A | | 4/2013 | |
| CN | 103061086 | A | | 4/2013 | |
| CN | 103061087 | A | | 4/2013 | |
| CN | 103087839 | A | | 5/2013 | |
| CN | 103103720 | A | | 5/2013 | |
| CN | 103103721 | A | | 5/2013 | |
| CN | 103122566 | A | | 5/2013 | |
| CN | 103122567 | A | | 5/2013 | |
| CN | 202913242 | U | | 5/2013 | |
| CN | 103225192 | A | | 7/2013 | |
| CN | 203049283 | U | | 7/2013 | |
| CN | 103361934 | A | | 10/2013 | |
| CN | 103361938 | A | | 10/2013 | |
| CN | 203370359 | U | | 1/2014 | |
| CN | 102061588 | B | | 2/2014 | |
| CN | 103556439 | A | | 2/2014 | |
| CN | 203530695 | U | | 4/2014 | |
| CN | 203530700 | U | | 4/2014 | |
| CN | 203530714 | U | | 4/2014 | |
| CN | 203530718 | U | | 4/2014 | |
| CN | 203530723 | U | | 4/2014 | |
| CN | 203530725 | U | | 4/2014 | |
| CN | 103285643 | B | | 4/2015 | |
| CN | 103451894 | B | | 11/2015 | |
| CN | 103556434 | B | | 11/2015 | |
| CN | 103556436 | B | | 11/2015 | |
| CN | 103556431 | B | | 1/2016 | |
| CN | 103556432 | B | | 3/2016 | |
| CN | 105420992 | A | | 3/2016 | |
| CN | 105420993 | A | | 3/2016 | |
| CN | 105421000 | A | | 3/2016 | |
| CN | 105442267 | A | | 3/2016 | |
| CN | 205329373 | U | | 6/2016 | |
| CN | 205329374 | U | | 6/2016 | |
| CN | 205329380 | U | | 6/2016 | |
| CN | 205329384 | U | | 6/2016 | |
| WO | WO99/32599 | | * | 7/1999 | C11D 17/06 |
| WO | WO-2011/051140 | A1 | | 5/2011 | |
| WO | WO-2011/098815 | A1 | | 8/2011 | |
| WO | WO-2012/035343 | A1 | | 3/2012 | |
| WO | WO2012035342 | | * | 3/2012 | C11D 11/00 |
| WO | WO2013/132223 | | * | 9/2013 | C11D 3/37 |
| WO | WO2013132223 | | * | 9/2013 | C11D 3/37 |
| WO | WO2014/006425 | | * | 1/2014 | C11D 3/37 |
| WO | WO-2014/006425 | A1 | | 1/2014 | |
| WO | WO-2015/004444 | A1 | | 1/2015 | |
| WO | WO-2015/075479 | A1 | | 5/2015 | |
| WO | WO-2015067965 | A1 | | 5/2015 | |
| WO | WO-2016/087351 | A1 | | 6/2016 | |
| WO | WO-2016087834 | A1 | | 6/2016 | |
| WO | WO-2020/012024 | A1 | | 1/2020 | |
| WO | WO-2020/064830 | A1 | | 4/2020 | |

* cited by examiner

CLEANING METHOD, APPARATUS AND USE

This invention relates to an improved method for cleaning a substrate which is or comprises a textile, especially a method for laundry cleaning of soiled substrates. This invention also relates to an apparatus suitable for performing said method.

BACKGROUND

The use of polymer particles in cleaning methods is known in the art. For example PCT patent publication WO 2007/128962 discloses a method for cleaning a soiled substrate using a multiplicity of polymeric particles. Other PCT patent publications which have similar disclosures in relation to the cleaning methods include: WO2012/056252, WO2014/006424; WO2015/0004444; WO2014/06425, WO 2012/035343 and WO2012/167545.

These prior art documents disclose a method for cleaning a soiled substrate which offers several advantages over conventional laundry methods including: improved cleaning performance and/or reduced water consumption and/or reduced detergent consumption and/or better low temperature (and thus more energy efficient) cleaning.

That said, the present inventors directed their efforts to achieving even better performance characteristics. In particular, the present inventors desired to solve one or more of the following technical problems:

I. To provide improved cleaning performance;

II. To provide good or improved cleaning performance in conjunction with smaller amounts of and/or simplified detergent formulations;

III. To provide a cleaning performance which was more repeatable and/or dependable;

IV. To inhibit colorant (especially dye) transferring from one substrate and depositing on another;

V. To keep the colours of textiles brighter for longer and to inhibit the colour fade which often tends to follow repeated cleaning;

VI. To inhibit soil cleaned from a soiled substrate from redepositing on the textile;

VII. To provide a technical solution offering any one or more of the above advantages over many cleaning cycles.

Without being limited by any theory it was surprisingly observed that when the cleaning particles comprised a thermoplastic polyamide and a hydrophilic material at least part of which is located inside the cleaning particle the above technical problems could be, at least in part, solved. This was particularly surprising to the inventors because it was not at all predictable that a hydrophilic material would exhibit any desirable effect when present in a thermoplastic polyamide matrix. In addition, it was not at all predictable that the hydrophilic material would exhibit desirable effects over many wash cycles.

DESCRIPTION

According to a first aspect of the present invention there is provided a method for cleaning a substrate which is or comprises a textile, the method comprising agitating the substrate and a cleaning composition comprising:

i. cleaning particles comprising a thermoplastic polyamide and a hydrophilic material at least part of which is located inside the cleaning particle, said cleaning particles having an average particle size of from 1 to 100 mm; and ii. a liquid medium.

Preferably, the invention provides a method for cleaning multiple washloads, wherein a washload comprises at least one substrate which is or comprises a textile, the method comprising agitating a first washload and a cleaning composition comprising:

i. cleaning particles comprising a thermoplastic polyamide and a hydrophilic material at least part of which is located inside the cleaning particle, said cleaning particles having an average particle size of from 1 to 100 mm; and ii. a liquid medium, wherein said method further comprises the steps of (a) recovering said cleaning particles comprising said thermoplastic polyamide and said hydrophilic material at least part of which is located inside said cleaning particle; (b) agitating a second washload comprising at least one substrate and a cleaning composition comprising the cleaning particles recovered from step (a), wherein said substrate is or comprises a textile; and (c) optionally repeating steps (a) and (b) for subsequent washload(s) comprising at least one substrate which is or comprises a textile.

The cleaning of an individual washload typically comprises the steps of agitating the washload with said cleaning composition in a cleaning apparatus for a cleaning cycle. A cleaning cycle typically comprises one or more discrete cleaning step(s) and optionally one or more post-cleaning treatment step(s), optionally one or more rinsing step(s), optionally one or more step(s) of separating the cleaning particles from the cleaned washload, optionally one or more drying step(s) and optionally the step of removing the cleaned washload from the cleaning apparatus.

According to the present invention, steps (a) and (b) may be repeated at least 1 time, preferably at least 2 times, preferably at least 3 times, preferably at least 5 times, preferably at least 10 times, preferably at least 20 times, preferably at least 50 times, preferably at least 100 times, preferably at least 200 times, preferably at least 300 times, preferably at least 400 at least or preferably at least 500 times.

Preferably the washload comprises at least one soiled substrate.

Preferably the liquid medium is an aqueous medium.

As noted above, it is surprising that the cleaning particles defined herein retain the hydrophilic material when used to clean multiple washloads of soiled substrate(s) in an aqueous medium. It will be appreciated that the recovery and re-use of the cleaning particles according to the method of the present invention to clean multiple washloads does not require the re-introduction or re-application of hydrophilic material into or onto the cleaning particle comprising the thermoplastic polyamide. Thus, in the method of the present invention, hydrophilic material need not be re-introduced or re-applied into or onto the cleaning particles comprising the thermoplastic polyamide between washloads, i.e. before re-use of the cleaning particle to clean a subsequent washload.

Substrate

The substrate is preferably a soiled substrate. The soil may be in the form of, for example, dust, dirt, foodstuffs, beverages, animal products such as sweat, blood, urine, faeces, plant materials such as grass, and inks and paints.

Textile

The textile may be in the form of an item of clothing such as a coat, jacket, trousers, shirt, skirt, dress, jumper, underwear, hat, scarf, overalls, shorts, swim wear, socks and suits. The textile may also be in the form of a bag, belt, curtains, rug, blanket, sheet or a furniture covering. The textile can also be in the form of a panel, sheet or roll of material which is later used to prepare the finished item or items.

The textile can be or comprise a synthetic fibre, a natural fibre or a combination thereof. The textile can comprise a natural fibre which has undergone one or more chemical modifications.

Examples of natural fibres include hair (e.g. wool), silk and cotton. Examples of synthetic textile fibres include Nylon (e.g. Nylon 6,6), acrylic, polyester and blends thereof.

The textile is preferably at least partly coloured, more preferably at least partly dyed.

The textile can be dyed with a VAT dye, more preferably a VAT Blue dye and especially an Indigo dye. The present invention has been found to be especially suitable for preventing dye transfer and/or the colour fade of textiles dyed with these dyes. A textile which is often dyed with these dyes (e.g. Indigo dye) is Denim.

The textile can be dyed with a Direct dye. Examples of Direct Dyes include Direct Blue 71, Direct Black 22, Direct Red 81.1 and Direct Orange 39.

The textile may comprise one or more items having different colours in different regions of the item and/or when two or more textiles are being cleaned together the textiles may comprise items having different colours.

The dye may be chemically attached to the textile. Examples of chemical attachment include covalent bonding, hydrogen bonding and ionic bonding. Alternatively, the dye may be physically adsorbed on the textile.

One or more textiles can be simultaneously cleaned by the method according to the first aspect of the invention. The exact number of textiles will depend on the size of the textiles and the capacity of the cleaning apparatus utilized.

The total weight of dry textiles cleaned at the same time is typically is from 1 to 200 Kg, more typically from 1 to 100 Kg, even more typically from 2 to 50 Kg and especially from 2 to 30 Kg.

Cleaning Particles

The cleaning particles may have an average mass of from about 1 mg to about 1000 mg, or from about 1 mg to about 700 mg, or from about 1 mg to about 500 mg, or from about 1 mg to about 300 mg, or from about 1 mg to about 150 mg, or from about 1 mg to about 70 mg, or from about 1 mg to about 50 mg, or from about 1 mg to about 35 mg, or from about 10 mg to about 30 mg, or from about 12 mg to about 25 mg, or from about 10 mg to about 800 mg, or from about 20 mg to about 700 mg, or from about 50 mg to about 700 mg, or from about 70 mg to about 600 mg from about 20 mg to about 600 mg.

The average volume of the cleaning particles may be in the range of from about 5 to about 500 $mm^3$, from about 5 to about 275 $mm^3$, from about 8 to about 140 $mm^3$, or from about 10 to about 120 $mm^3$, or at least 40 $mm^3$, for instance from about 40 to about 500 $mm^3$, or from about 40 to about 275 $mm^3$.

The cleaning particles preferably have an average particle size of at least 1 mm, more preferably at least 2 mm and especially at least 3 mm.

The cleaning particles preferably have an average particle size no more than 70 mm, more preferably no more than 50 mm, even more preferably no more than 40 mm, yet more preferably no more than 30 mm, still more preferably no more than 20 mm and most preferably no more than 10 mm.

Preferably, the cleaning particles have an average particle size of from 1 to 20 mm, more preferably from 1 to 10 mm.

Cleaning particles which offer an especially prolonged effectiveness over a number of wash cycles are those with an average particle size of at least 5 mm, preferably from 5 to 10 mm.

The above mentioned particle sizes provide especially good cleaning performance whilst also permitting the cleaning particles to be readily separable from the substrate at the end of the cleaning method.

The average particle size is preferably a number average. The determination of the average particle size is preferably performed by measuring the particle size of at least 10, more preferably at least 100 cleaning particles and especially at least 1000 cleaning particles.

The size is preferably the largest linear dimension (length). For a sphere this equates to the diameter. The size is preferably determined using Vernier callipers.

The cleaning particles comprise a thermoplastic polyamide. A thermoplastic as used herein preferably means a material which becomes soft when heated and hard when cooled. This is to be distinguished from thermosets (e.g. rubbers) which will not soften on heating. A more preferred thermoplastic is one which can be used in hot melt compounding and extrusion.

The thermoplastic polyamide preferably is or comprises an aliphatic or aromatic polyamide, more preferably is or comprises an aliphatic polyamide.

Preferred polyamides are those comprising aliphatic chains, especially $C_4$-$C_{16}$, $C_4$-$C_{12}$ and $C_4$-$C_{10}$ aliphatic chains.

The polyamide preferably has a solubility in water of no more than 1 wt %, more preferably no more than 0.1 wt % in water and most preferably the polyamide is insoluble in water. Preferably the water is at pH 7 and a temperature of 20° C. whilst the solubility test is being performed. The solubility test is preferably performed over a period of 24 hours. The polyamide is preferably not degradable. By the words "not degradable" it is preferably meant that the polyamide is stable in water without showing any appreciable tendency to dissolve or hydrolyse. For example, the polyamide shows no appreciable tendency to dissolve or hydrolyse over a period of 24 hrs in water at pH 7 and at a temperature of 20° C. Preferably a polyamide shows no appreciable tendency to dissolve or hydrolyse if no more than about 1 wt %, preferably no more than about 0.1 wt % and preferably none of the polyamide dissolves or hydrolyses, preferably under the conditions defined above.

Preferred thermoplastic polyamides are or comprise Nylons. Preferred Nylons include Nylon 4,6, Nylon 4,10, Nylon 5, Nylon 5,10, Nylon 6, Nylon 6,6, Nylon 6/6,6, Nylon 6,6/6,10, Nylon 6,10, Nylon 6,12, Nylon 7, Nylon 9, Nylon 10, Nylon 10,10, Nylon 11, Nylon 12, Nylon 12,12 and copolymers or blends thereof. Of these, Nylon 6, Nylon 6,6 and Nylon 6,10 and copolymers or blends thereof are preferred. It will be appreciated that these Nylon grades of polyamides are not degradable, wherein the word degradable is preferably as defined above.

The polyamide may be crystalline or amorphous or a mixture thereof.

Other polymers may be present in addition to the polyamide.

The polyamide can be linear, branched or partly cross-linked (provided that the polyamide is still a thermoplastic in nature), more preferably the polyamide is linear.

The cleaning particles preferably have an average density of greater than 1 g/cm$^3$, more preferably greater than 1.1 g/cm$^3$ and even more preferably greater than 1.2 g/cm$^3$ and especially preferably greater than 1.3 g/cm$^3$.

The cleaning particles preferably have an average density of no more than 3 g/cm$^3$ and especially no more than 2.5 g/cm$^3$.

Preferably, the cleaning particles have an average density of from 1.2 to 3 g/cm$^3$.

These densities are advantageous for further improving the degree of mechanical action which assists in the cleaning process and which can assist in permitting better separation of the cleaning particles from the substrate after cleaning.

Preferably, the cleaning particles comprise a filler. The filler is preferably present in the cleaning particle in an amount of at least 5 wt %, more preferably at least 10 wt %, even more preferably at least 20 wt %, yet more preferably at least 30 wt % and especially at least 40 wt % relative to the total weight of the cleaning particle. The filler is typically present in the cleaning particle in an amount of no more than 90 wt %, more preferably no more than 85 wt %, even more preferably no more than 80 wt %, yet more preferably no more than 75 wt %, especially no more than 70 wt %, more especially no more than 65 wt % and most especially no more than 60 wt % relative to the total weight of the cleaning particle.

The weight percentage of filler is preferably established by ashing. Preferred ashing methods include ASTM D2584, D5630 and ISO 3451, and preferably the test method is conducted according to ASTM D5630. For any standards referred to in the present invention, unless specified otherwise, the definitive version of the standard is the most recent version which precedes the priority filing date of this patent application.

The cleaning particles can be substantially spherical, ellipsoidal, cylindrical or cuboid. Cleaning particles having shapes which are intermediate between these shapes are also possible.

The best results for cleaning performance and separation performance (separating the substrate from the cleaning particles after the cleaning steps) in combination are typically observed with ellipsoidal particles. Spherical particles tend to separate best but do not clean as effectively. Conversely, cylindrical or cuboid particles separate poorly but clean effectively.

Preferably, the cleaning particles are not perfectly spherical. Preferably, the cleaning particles have an average aspect ratio of greater than 1, more preferably greater than 1.05, even more preferably greater than 1.07 and especially greater than 1.1. Preferably, the cleaning particles have an average aspect ratio of less than 5, more preferably less than 3, even more preferably less than 2, yet more preferably less than 1.7 and especially less than 1.5. The average is preferably a number average. The average is preferably performed on at least 10, more preferably at least 100 cleaning particles and especially at least 1000 cleaning particles. The aspect ratio for each particle is preferably given by the ratio of the longest linear dimension divided by the shortest linear dimension. This is preferably measured using Vernier Callipers.

A particularly good balance of cleaning performance and substrate care can be achieved when the average aspect ratio is within the abovementioned values. When the cleaning particles have a very low aspect ratio (e.g. highly spherical or ball shaped cleaning particles) it is observed that the cleaning particles do not provide sufficient mechanical action for good cleaning characteristics to develop. When the cleaning particles have an aspect ratio which is too high it is observed that the removal of the particles from the textile becomes more difficult and/or the abrasion on the textile can become too high leading to unwanted damage to the textile.

The method of the present invention preferably uses a multiplicity (large number) of cleaning particles. Typically, the number of cleaning particles is no less than 1000, more typically no less than 10,000, even more typically no less than 100,000. The present inventors consider that the large number of cleaning particles is particularly advantageous in preventing creasing and/or for improving the uniformity of cleaning of the textile.

Preferably, the ratio of cleaning particles to dry substrate is at least 0.1, especially at least 0.5 and more especially at least 1:1 w/w. Preferably, the ratio of cleaning particles to dry substrate is no more than 30:1, more preferably no more than 20:1, especially no more than 15:1 and more especially no more than 10:1 w/w.

Preferably, the ratio of the cleaning particles to dry substrate is from 0.1:1 to 30:1, more preferably from 0.5:1 to 20:1, especially from 1:1 to 15:1 w/w and more especially from 1:1 to 10:1 w/w.

Liquid Medium

The liquid medium is preferably aqueous (i.e. the liquid medium is or comprises water). In order of increasing preference, the liquid medium comprises at least 50 wt %, at least 60 wt %, at least 70 wt %, at least 80 wt %, at least 90 wt %, at least 95 wt % and at least 98 wt % of water.

The liquid medium may optionally comprise one or more organic liquids including for example alcohols, glycols, glycol ethers, amides and esters. Preferably, the sum total of all organic liquids present in the liquid medium is no more than 10 wt %, more preferably no more than 5 wt %, even more preferably no more than 2 wt %, especially no more than 1% and most especially the liquid medium is substantially free from organic liquids.

The liquid medium preferably has a pH of from 3 to 13, more preferably from 4 to 12, even more preferably 5 to 10, especially 6 to 9 and most especially 7 to 9. These pH conditions are especially fabric kind.

It can also be desirable to clean a substrate under high pH conditions. Such conditions offer improved cleaning performance but can be less kind to some substrates. Thus, it can be desirable that the liquid medium has a pH of from 7 to 13, more preferably from 7 to 12, even more preferably from 8 to 12 and especially from 9 to 12.

So as to obtain the abovementioned pH values it is advantageous that the cleaning composition additionally comprises an acid and/or a base. Preferably, the abovementioned pH is maintained for at least a part of the duration, more preferably all of the duration of the agitation.

So as to prevent the pH of the liquid medium from drifting during the cleaning it is advantageous that the cleaning composition comprises a buffer.

The present inventors have found that it is possible to use surprisingly small amounts of liquid medium whilst still achieving good cleaning performance. This has environmental benefits in terms of water usage, waste water treatment and the energy required to heat or cool the water to the desired temperature.

Preferably, the weight ratio of the liquid medium to the dry substrate is no more than 20:1, more preferably no more than 10:1, especially no more than 5:1, more especially no more than 4.5:1 and even more especially no more than 4:1 and most especially no more than 3:1. Preferably, the weight ratio of liquid medium to the dry substrate is at least 0.1:1, more preferably at least 0.5:1 and especially at least 1:1.

Hydrophilic Material

The hydrophilic material preferably is or comprises a material which is soluble or swellable in water, more preferably soluble in water. The hydrophilic material is or comprises a material which is preferably at least 1 wt % soluble, even more preferably 5 wt % soluble and especially at least 10 wt % soluble in water. When the hydrophilic material is swellable in water it preferably absorbs at least 30 wt %, more preferably at least 50 wt %, even more preferably at least 70 wt %, yet more preferably at least 100 wt % of water relative to the weight of the hydrophilic material.

The temperature for any solubility or swellability measurement is preferably 25° C. The pH for the solubility or swellability measurement is preferably 7. When the hydrophilic material has ionic groups these are preferably in the salt form. For anionic groups these are preferably in the sodium salt form, for cationic groups these are preferably in the chloride form. Because dissolution and swelling can take some time the above measurements are preferably made after 24 hours of contact of the hydrophilic material with water.

Preferred hydrophilic materials comprise at least one hydrophilic group in the molecular structure. The hydrophilic groups can be ionic (which may be cationic and/or anionic) or non-ionic.

Preferred examples of non-ionic hydrophilic groups include —OH groups, pyrrolidone groups, imidazole groups and ethyleneoxy groups.

Preferred examples of non-ionic hydrophilic groups include the repeat units: —$[CH_2CH_2O]_n$— (ethylene glycol residue) and —$(CH_2CHZ)_n$— wherein Z is an OH group (vinyl alcohol residue), an amide group (especially an acrylamide residue), a pyrrolidone group (n-vinyl pyrrolidone residue) or an imidazole group (n-vinyl imidazole residue) and n has a value of 1 or more.

Preferred examples of anionic hydrophilic groups include carboxylates, sulfonates, sulphates, phosphonates and phosphates. These may be in the free acid, in the salt form or a mixture thereof. Preferably, the anionic hydrophilic groups are at least partially, more preferably completely in the salt form. Preferably, the salt form is an alkali metal such as sodium, lithium or potassium. The hydrophilic groups in the hydrophilic material may be provided by hydrolysing a hydrolysable group. Suitable examples of hydrolysable groups include carboxylic acid esters and acid anhydrides (sometimes called organic acid anhydrides). When the hydrophilic groups are carboxylates these may be provided by synthesizing a compound having one or more carboxylic acid ester and/or acid anhydride groups which is/are subsequently hydrolysed. Methyl, ethyl and t-butyl esters of carboxylic acids and especially acid anhydrides are preferred. Hydrolysis can be effected by acidic or basic pH, using somewhat elevated temperatures of from 30 to 100° C. and in the presence of water.

Preferred examples of cationic hydrophilic groups include ammonium groups (such as alkyl and aryl ammonium salts), azetidinium groups, pyridinium groups, imidazolium groups, morpholinium groups, guanide and biguanide groups. These may be in the free acid, in the salt form or a mixture thereof. Preferably, the cationic hydrophilic groups are at least partially, more preferably fully in the salt form. Preferably, the salt form is a halide especially a chloride.

The hydrophilic material can be or comprise a polymer. The polymer may be linear, branched or cross-linked. Swellable hydrophilic materials are often cross-linked. Soluble hydrophilic materials are generally linear or branched. Swellable cross-linked hydrophilic materials are also known in the art as those capable of forming hydrogels.

The hydrophilic material preferably is or comprises a surfactant, a dye transfer inhibiting (DTI) agent or a builder. The hydrophilic martial can be or comprise a polyether.

The cleaning particles can each comprise one hydrophilic material or two or more hydrophilic materials. Each cleaning particle can comprise two or more hydrophilic materials selected from the groups i to iii; i. surfactants, ii. DTIs and iii. builders. The hydrophilic materials can be selected from a different group, from the same group or combinations thereof. Equally the cleaning particles can be a physical mixture of two or more different cleaning particles each one containing a different hydrophilic material.

Preferably, the hydrophilic material is thermally stable even at the hot melt temperatures required, for example to hot melt mix and extrude Nylon. That is to say that the hydrophilic material is preferably thermally stable at a temperature of 200° C., more preferably at 225° C., especially at 250° C., more especially 275° C. and most especially at 300° C.

The present inventors have surprisingly found that the performance characteristics of the present method are improved using the method according to the first aspect of the present invention. Even more surprising is that the performance is retained even after many cleaning cycles.

In order of increasing preference, the hydrophilic material is still present in the cleaning particles after 2, after 3, after 5, after 10, after 20, after 50, after 100, after 200, after 300, after 400 and after 500 cleaning cycles. A cleaning cycle ends after the cleaning particles are separated from the substrate. A typical cleaning cycle is around 1 hour in duration. A typical cleaning temperature is 25° C. Preferably, in order of increasing preference the cleaning particles still comprise at least 1 wt %, at least 5 wt %, at least 10 wt %, at least 20 wt %, at least 30 wt %, at least 40 wt % and at least 50 wt % of the original amount of hydrophilic material after the above mentioned numbers of cycles.

The amount of hydrophilic material remaining in the cleaning particle can be measured by extraction and especially soxhlet extraction. The hydrophilic material can be detected and quantified in the extract by many methods including UV detection, RI detection and especially gravimetric analysis.

Surfactants as the Hydrophilic Materials

The hydrophilic material can be or comprise a surfactant. The surfactant can be a non-ionic, a cationic, an anionic or a zwitterionic surfactant.

Of these anionic surfactants are preferred. As mentioned above these can be in the free acid, the salt form or as a mixture thereof.

Preferred surfactants are those comprising one or more sulfonate and/or sulfate groups more preferably one or more sulfonate groups. Especially suitable surfactants include alkyl sulfonates, aryl sulfonates, and alkylaryl sulfonates. Some examples of suitable sulfonate surfactants are alkylbenzene sulfonates, naphthalene sulfonates, alpha-olefin sulfonates, petroleum sulfonates, and sulfonates in which the hydrophobic group includes at least one linkage that is selected from ester linkages, amide linkages, ether linkages (such as, for example, dialkyl sulfosuccinates, amido sulfonates, sulfoalkyl esters of fatty acids, and fatty acid ester sulfonates), and combinations thereof. Some suitable sulfate surfactants include, for example, alcohol sulfate surfactants, ethoxylated and sulfated alkyl alcohol surfactants, ethoxylated and sulfated alkyl phenol surfactants, sulfated carboxylic acids, sulfated amines, sulfated esters, and sulfated natural oils or fats.

Dodecyl benzene sulfonate is an especially preferred surfactant. This surfactant has been found to provide especially good cleaning performance and is particularly thermally stable. The alkali metal salts and especially the sodium salt of dodecyl benzene sulfonate are preferred.

Different polymers tend to have very different barrier properties. Some polymers will markedly inhibit or prevent diffusion of a hydrophilic material and especially a surfactant whilst other polymers allow diffusion to progress so rapidly that no long term benefits are attainable. In this context, it was surprisingly found that the cleaning performance of the present invention was improved when the hydrophilic material was a surfactant.

A further surprising benefit of the present invention was found to be that the surfactant was not leached from cleaning particles over just one cleaning cycle. Thus, desirable improvements in cleaning performance were observed over many wash cycles.

The hydrophilic material can comprise two or more surfactants. A mixture of non-ionic and anionic surfactants can be especially advantageous. Accordingly, it is possible to utilise cleaning particles each particle comprising two more different surfactants, especially each cleaning particle comprising an ionic (preferably anionic) and a non-ionic surfactant.

It is also possible to utilise a physical mixture of two or more different kinds of cleaning particles. For example the first cleaning particles can comprise an ionic (especially anionic) surfactant and the second cleaning particles can comprise a non-ionic surfactant.

Dye Transfer Inhibitors (DTIs) as the Hydrophilic Materials

The hydrophilic material can be or comprise a dye transfer inhibitor (DTI). A dye transfer inhibitor is a material which tends to bind with or associate with a dye. In the cleaning method a dye transfer inhibitor is especially useful for inhibiting or preventing colour to colour transfer, for example from one textile to another.

The hydrophilic material can comprise two or more DTIs.

Preferably, the DTI is or comprises a polymer and more preferably is or comprises a nitrogen-containing polymer.

Suitable examples of polymeric DTIs include: homo- or copolymers of ethyleneimine, nitrogen containing (meth) acrylates, N-vinylpyrrolidone, N-vinylimidazole, N-vinylcaprolactam, 4-vinylpyridine, diallyldimenthylammonium chloride, N-vinylformamide, N-vinylacetamide, vinylamine, allylamine, acrylamide and N-substituted acrylamides and wherein the nitrogen atoms are optionally derivatized.

Preferred examples of polymeric DTIs include those wherein the polymer comprises one or more repeat units obtained by polymerising vinyl pyrrolidone. More preferably, the polymeric DTI comprises the repeat units obtained by copolymerizing vinyl pyrrolidone and vinyl imidazole. Especially preferred DTIs include Sokalan® HP, more preferably HP56, Sokalan is a tradename of BASF. Also suitable are the Kollidon® materials and especially Kollidon® K30 (linear) and Kollidon® CL (which is cross-linked), which is obtained by polymerisation of vinyl pyrrolidone. Kollidon is a tradename of BASF. Another polymer which is found to be useful as a DTI of this kind is Divergan® HM, this is a cross-linked copolymer obtained by copolymerisation of vinyl pyrrolidone and vinyl imidazole. It has been found that these preferred polymeric DTIs provide performance advantages over an extended number of wash cycles.

Polymeric DTI's obtained by polymerising vinyl pyrrolidone and especially obtained by copolymerising vinyl pyrrolidone and vinyl imidazole have been found to provide especially good dye transfer inhibition and/or colour fade inhibition especially when the textile is dyed with a VAT dye, more especially when dyed with a VAT blue dye and even more especially when the textile is dyed with an indigo dye. A particularly suitable textile is cotton, more especially denim. Thus, the present invention provides a method for cleaning a denim textile dyed with a VAT blue dye (especially indigo dye) which provides significantly reduced colour fading after one or more cleaning cycles according to the method of the present invention.

Polymeric DTI's obtained by polymerising vinyl pyrrolidone and especially obtained by copolymerising vinyl pyrroldione and vinyl imidazole have been found to provide especially good dye transfer inhibition and/or colour fade inhibition especially when the textile is dyed with a Direct Dye, especially Direct Black 22, Direct Blue 71 or Direct Red 83.1

The present inventors have found that the presence of a DTI in the cleaning particle is able to provide reduced dye transfer even after many wash cycles. It was also observed that the presence of a DTI improves the brightness of the colours on the textiles, especially after repeated cleaning according to the method of the first aspect of the present invention. That is to say that colour fade of the textile is inhibited. This was surprising as one might presume or expect that adsorption of vagrant dye for improved DTI performance might be at the expense of colour fade. These benefits over many cycles were particularly notable with the preferred DTIs as mentioned above.

A further preferred hydrophilic polymeric DTI is one which is or comprises a polyether, more preferably a polyether block polyamide. The polyether block is preferably polyethyleneoxy. Preferably the polyether block segments of the copolymer are flexible and the polyamide block segments are rigid in the block copolymer. The polyamide in this context is preferably an aliphatic polyamide, and preferably selected from conventional aliphatic polyamides such as polyamide 6 and polyamide 12. An especially preferred grade of polyether block polyamide is that sold by Arkema under the Pebax tradename and especially Pebax MH1657. These kinds of hydrophilic materials have been found to be particularly effective at dye transfer inhibition and/or colour fade reduction with textiles dyes with Direct Dyes, notably Direct Orange 39. In addition, these kinds of hydrophilic materials can also assist in reducing garment shrinkage which sometimes occurs during cleaning.

The combination of a hydrophilic material which is a DTI obtained by polymerising vinyl pyrrolidone (especially obtained by copolymerising vinyl pyrroldione and vinyl imidazole) and a hydrophilic material which is a polyether (especially a polyether block polyamide) has been found to be especially advantageous for improved dye transfer inhibition and/or reduced colour fade of the textile. In this way the range of dyes which are effectively inhibited from transferring can be extended and the amounts of transferred dyes can be synergistically reduced.

As before, the hydrophilic materials can be present in the same cleaning particles or the cleaning particles can be of two or more kinds which are physically blended. Thus, a preferred embodiment of the present invention is wherein the cleaning particles comprise a combination of a first type of cleaning particle comprising a DTI obtained by polymerising vinyl pyrrolidone and a second type of cleaning particle comprising a polyether.

When the hydrophilic material is a polymer, the polymer can also be a hydrophilic polyester, polycarbonate or polyurethane polymer, typically which comprises one or more hydrophilic groups, especially one or more polyethyleneoxy groups.

The present inventors found that cleaning particles which comprise polyether block polyamides provided benefits in relation to dye transfer inhibition and/or improved long term retention of textile colour. This was surprising as polyether block polyamides are typically sold for their breathability or antistatic character. For the purposes of the present invention polyethers and especially polyester block polyamides are to be regarded as DTI's.

Builder as the Hydrophilic Material

The hydrophilic material can be or comprise a builder. Builders are chemical compounds that soften water, typically by removing cations (especially calcium and magnesium cations).

Suitable builders include the alkali metal, ammonium and alkanolammonium salts of polyphosphates, alkali metal silicates, aluminosilicates, polycarboxylate compounds, ether hydroxypolycarboxylates, copolymers of maleic anhydride with acrylic acid, ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and salts thereof.

Preferably, the builder is or comprises a polymer having carboxylic acid groups or salts thereof. Preferred salts are the alkali metals (e.g. sodium and potassium), especially sodium.

Preferably, the builder is or comprises a polymer comprising repeat units obtained from polymerizing one or more of the monomers selected from maleic acid, acrylic acid, methacrylic acid, ethacrylic acid, vinylacetic acid, allylacetic acid, itaconic acid, 2-carboxy ethyl acrylate and crotonic acid which may be in the form of the free acid or salt thereof, more preferably one or more monomers selected acrylic acid, methacrylic and maleic acid which may be in the form of the free acid or salt thereof.

More preferably the builder is or comprises a polymer or copolymer of maleic acid, even more preferably the builder is or comprises a copolymer of maleic acid-co-acrylic acid which may be in the form of the free acid or salt thereof. A preferred example of this is Sokalan® CP5 available from BASF which for the purposes of this invention is regarded to be a builder.

The present inventors have found improvements in cleaning performance when the cleaning particles comprise a builder even after several wash cycles.

Two or more builders can be present. These builders can be in the same cleaning particles or in different cleaning particles which are then physically blended together.

Amounts of Hydrophilic Material

The hydrophilic material is preferably present in an amount of at least 0.01 wt %, more preferably at least 0.1 wt %, even more preferably at least 0.5 wt % and especially at least 1 wt % relative to the total weight of the cleaning particles.

In order of increasing preference the hydrophilic material is present in an amount of no more than 90 wt %, no more than 80 wt %, no more than 70 wt %, no more than 60 wt %, no more than 50 wt %, no more than 40 wt %, no more than 30 wt %, no more than 25 wt %, no more than 20 wt %, no more than 15 wt % and no more than 10 wt % relative to the total weight of the cleaning particles.

Preferably, the hydrophilic material is present in an amount of from 0.1 to 15 wt %, more preferably from 0.1 to 10 wt % and especially from 1 to 10 wt % relative to the total weight of the cleaning particles.

The amounts described immediately hereinabove are preferred for hydrophilic materials other than the polyethers (especially polyether block polyamides) described herein.

When the hydrophilic material is or comprises a polyether (more preferably is or comprises a polyether block polyamide) then in order of increasing preference the amount of polyether present is at least 1 wt %, at least 2 wt %, at least 5 wt %, at least 10 wt %, at least 15 wt % and at least 20 wt % relative to the total weight of the cleaning particle. When the hydrophilic material is or comprises a polyether (more preferably is or comprises a polyether block polyamide) then in order of increasing preference the amount of polyether present is no more than 95 wt %, no more than 90 wt %, no more than 80 wt %, no more than 70 wt %, no more than 60 wt % and no more than 50 wt % relative to the total weight of the cleaning particles. Preferably, the amount of polyether (more preferably polyether block polyamide) present is from 1 to 50 wt %, more preferably from 5 to 50 wt % relative to the total weight of the cleaning particle.

Located Inside the Cleaning Particles

At least a part of the hydrophilic material must be present inside the particles. Thus, merely adsorbing or depositing hydrophilic materials on the surface of the cleaning particles is not within the scope of the present invention. For example, absorbing a surfactant onto a thermoplastic polyamide particle is not within the scope of the present invention because the surfactant is not located inside the cleaning particle.

By located inside it is preferably meant that the hydrophilic material is underneath the surface of the cleaning particle, typically underneath the thermoplastic polyamide or other optional components. Typically, the hydrophilic material is dispersed throughout the thermoplastic polyamide. A portion of the hydrophilic material may be adsorbed onto the surface of the optional filler particles.

In order of increasing preference at least 5 wt %, at least 10 wt %, at least 20 wt %, at least 30 wt %, at least 40 wt %, at least 50 wt %, at least 60 wt %, at least 70 wt %, at least 80 wt %, at least 90 wt % and at least 95 wt % of the hydrophilic material is located inside the cleaning particle. The remainder of the hydrophilic material (i.e. to make 100 wt %) is present on the surface of the cleaning particle.

Several methods exist to quantify the amount of the hydrophilic material inside the cleaning particle and the amount on the surface.

For establishing the amount of the hydrophilic material on the surface a preferred method is to wash the cleaning particles with water at 20° C. and to determine the amount of hydrophilic material in the water. Preferably, an equal weight of the cleaning particles and water are mixed for 10 minutes at 20° C. The water used to wash the cleaning particles is preferably suitably pure and free of solutes. Preferably, the water has been purified by means of reverse osmosis, deionization, distillation or a combination thereof. Distilled water is especially suitable. The cleaning particles are removed by filtration leaving a filtrate which contains the hydrophilic material from the surface of the cleaning particles. A sample of the filtrate is then taken and the amount of the hydrophilic material in the filtrate is established by methods such as gravimetric analysis, UV-visible spectroscopy or viscosity measurement, but more preferably by refractive index measurements. A known amount of the filtrate may also be dried and the amount of hydrophilic material can then be established gravimetrically. In any case, the total amount of hydrophilic material is then simply the concentration in the filtrate multiplied by the total amount of filtrate. More preferably, the concentration of hydrophilic material in the filtrate is determined by GPC fitted with a refractive index detector. The refractive index detector responses are preferably calibrated using known concentrations of the hydrophilic material in water. Once the concentration of the hydrophilic material is known in the filtrate then multiplying this by the total amount of the filtrate provides the total amount of hydrophilic material on the surface of the cleaning particles.

Alternatively, the weight of the cleaning particles before and after the washing with 20° C. water can be used to gravimetrically calculate the amount of hydrophilic material on the particle surface. The weights of the cleaning particles both before and after the washing/filtration steps can be measured following the step of conditioning the cleaning particles to 70% relative humidity at 20° C. for a period of 3 days. The cleaning particles obtained after filtration are preferably partially dried by a drip dry method which allows the cleaning particles to drip water for period of 10 minutes prior to the conditioning.

For establishing the total amount of hydrophilic material (located inside and on the surface), techniques such as mass spectroscopy, atomic absorption spectroscopy, infra-red, UV, and NMR spectroscopy may be used, but it is preferred to establish the total amount of hydrophilic material by extracting the hydrophilic material by refluxing water over the cleaning particles. The water quality used for extraction is as preferred for washing the cleaning particles as mentioned above. Extraction is preferably done at a temperature of 100° C. The extraction is preferably performed for 16 hours, more preferably 24 hours and especially 48 hours. The amount of hydrophilic material can be established by gravimetric analysis, typically by weighing the cleaning particles before and after extraction. The weight of the cleaning particles are preferably obtained after the abovementioned conditioning step. The abovementioned drip dry method is preferably employed for the extracted beads prior to the conditioning step. More preferably, however, the concentration of hydrophilic material in the extract is determined by GPC fitted with a refractive index detector. The refractive index detector responses are preferably calibrated using known concentrations of the hydrophilic material in water. Once the concentration of the hydrophilic material is known in the extract then multiplying this by the total amount of the extract provides the total amount of hydrophilic material extracted from the cleaning particles (inside and on the surface of the cleaning particles).

A more preferred method for establishing the total amount of hydrophilic material (located inside and on the surface) fully dissolves the particles in a solvent for the thermoplastic polyamide. Examples of suitable solvents include formic acid, phenols, cresols and sulphuric acid. Of these formic acid is especially preferred. Preferably, the cleaning particles are allowed to dissolve in the formic acid at a temperature of 25° C. Once the solution is obtained the amount of the hydrophilic material can then be established by, for example, HPLC or GPC, especially using a refractive index detector. This method has the advantage that it works even with those hydrophilic materials which extract less rapidly in water.

Semi-quantitative methods to establish that the hydrophilic material is not merely at the surface include sectioning the cleaning particles and exploring the particle interior using methods such as visible microscopy or more preferably scanning electron microscopy (SEM). Regions or areas of the hydrophilic material may already have sufficient contrast so as to be conspicuous or the contrast can be enhanced by staining techniques. In the case of SEM it is also possible to use energy-dispersive x-ray spectroscopy so as to help identify the locations where the hydrophilic material resides. Atomic force microscopy (AFM) can also be used. The advantage of these semi-quantitative methods is the visualization of concentration gradients.

The hydrophilic material may be located inside each cleaning particle in discrete areas, the hydrophilic material may be molecularly dissolved in the thermoplastic polyamide matrix or the hydrophilic material may exist in both of these states in different parts of the cleaning particles.

Preferably, the hydrophilic material is dispersed throughout each cleaning particle. Preferably, the hydrophilic material is dispersed substantially uniformly throughout each cleaning particle.

Preferably, in any cleaning particle there are substantially no phase-separated domains of the hydrophilic material having any linear dimension which is larger than 1 mm, more preferably larger than 0.5 mm and especially larger than 0.2 mm. The preferred method for establishing the domain size of hydrophilic regions is cross-sectioning of the cleaning particles followed by straining and then investigation by Scanning Electron Microscopy or Computer Tomography.

Preparation of Cleaning Particles

The cleaning particles can be prepared by any number of suitable methods providing that the result is that at least some of the hydrophilic material is located inside the resulting particles. Preferably, the cleaning particles are prepared by a process which comprises extrusion, especially extrusion of a mixture comprising the thermoplastic polyamide and the hydrophilic material along with any optional materials. Preferably, the extrusion is performed at elevated temperatures so that the mixture is fluid. The extrusion is typically performed by forcing the mixture of the thermoplastic polyamide and the hydrophilic material through a die having one or more holes.

The extruded material is preferably cut to the desired size using one or more cutters.

The combination of extrusion and cutting is generally termed pelletizing. It is especially preferred that the pelletizing is under-liquid (especially under-water) pelletizing, for example as outlined in PCT patent publication WO2004/080679.

Preferably, the extrusion is performed such that the extruded material enters a cutting chamber containing a liquid coolant. The coolant preferably is or comprises water. The cutting chamber may be at atmospheric or elevated pressure. Preferably, the cutting is performed as the extruded material enters the cutting chamber containing a liquid coolant. The coolant preferably has a temperature of from 0 to 130° C., more preferably from 5 to 100° C., even more preferably from 5 to 98° C. The coolant may also have a temperature of from 10 to 70° C. or from 20 to 50°.

When preparing cleaning particles containing one or more surfactants it is preferred that the liquid coolant comprises one or more defoaming agents (sometimes also called anti-foaming agents). Without defoaming agents, the inventors observed significant problems with excessive foam production during the preparation of the cleaning particles which comprise one or more surfactants.

Examples of defoaming agents include oil-based, powder-based, water-based, silicon-based, polyalkyleneoxy-based and poly alkyl acrylate-based defoaming agents. The word "based" as used herein has the same meaning as comprising. Thus, silicon-based also means a defoaming agent comprising silicon.

Suitable oil-based defoaming agents include mineral oil, vegetable oil and white oil.

Suitable power-based defoaming agents include for example particulate silica, the silica is often dispersed in a composition comprising an oil-based defoaming agent.

Suitable water-based defoaming agents are typically oil-based defoaming agents, waxes, fatty acids or esters which are dispersed in water.

Preferred silicon-based defoaming agents are those comprising silicone (—Si—O— linkages) and especially polydialkylsiloxanes such as polydimethylsiloxane (PDMS). These may optionally also comprise fluorine atoms (fluoro siloxanes).

Suitable polyalkyleneoxy-based defoaming agents include those comprising both ethyleneoxy and propyleneoxy repeat units (EO/PO), which can be randomly distributed or more typically distributed in blocks.

Preferred defoaming agents are stearates and especially silicon-based defoaming agents as mentioned above.

The amount of defoaming agent present in the liquid coolant is typically quite small e.g. less than 5%, more preferably less than 2%, even more preferably less than 1% and in some cases less than 0.1% by weight relative to the weight of the coolant. The amount of defoaming agent present in the liquid coolant is preferably at least 0.0001%, more preferably at least 0.001% by weight relative to the weight of the coolant.

The cutting chamber may be pressurized to a pressure of up to 10 bar, more preferably up to 6 bar, even more preferably from 1 to 5 bar, yet more preferably from 1 to 4 bar, especially preferably from 1 to 3 bar and most especially from 1 to 2 bar.

The cutting chamber may be at atmospheric pressure.

Cutting is preferably performed by one or more knife heads which typically can rotate at speeds of from 300 to 5000 revolutions per minute.

The time between the extrudate exiting the die and it being cut is typically in the order of milliseconds. Preferred times are not more than 20, more preferably not more than 10 and especially not more than 5 milliseconds.

The temperature of the extruded material as it exits the die is typically from 150 to 380° C., more preferably from 180 to 370° C. and even more especially from 250 to 370° C. Preferably, the temperature of the extrudate at the time of cutting is not than 20° C. below the exit temperatures mentioned directly above.

Prior to extrusion it is typically advantageous to homogeneously mix the thermoplastic polyamide and the hydrophilic material along with any optional additives. The mixing is preferably performed in mixers such as screw extruders, twin screw extruders, Brabender mixers, Banbury mixers and kneading apparatus. Typically the mixing is performed at high temperatures, typically from 240 to 350° C., more typically from 245 to 310° C. The time required for mixing is typically from 0.2 to 30 minutes. Longer mixing times can be advantageous to promote smaller domains of the hydrophilic material inside the thermoplastic polyamide. It can also be advantageous to re-extrude the cleaning particles. This can be done one or more times. As an example, the cleaning particles can be extruded 2, 3 or 4 times in total.

The hydrophilic material and other optional components (e.g. filler) can be added to the thermoplastic polyamide in a mixer, mixed and then extruded.

Some commercially available extruders operate with different feeding zones for feeding in the materials to the thermoplastic. Extruders having 2 or more feeding zones are preferred, especially those having from 2 to 30 feeding zones, more preferably from 2 to 15 feeding zones, even more preferably from 2 to 12 feeding zones or from 2 to 9 feeding zone. Extruders typically comprise one or more screws which act to mix the materials and to urge them towards the die. Furthest from the die (zone 1 or 2) the temperature in that zone is preferably cooler and nearer the die (e.g. zone 4 or 5) the temperature in that zone is preferably hotter. In the extrusion process the hydrophilic material can be fed to the polyamide at any one or more of the different feeding zones. That being said, in order to provide cleaning particles with a more prolonged effectiveness over many wash cycles it was found to be preferable to add the hydrophilic material to the polyamide in an earlier feeding zone (furthest from the die). This procedure is sometimes known as "cold feed extrusion". The hydrophilic material is preferably fed into the extruder in zone 1, 2 or 3, more preferably in zone 1 or 2 and especially in zone 1. By feeding the hydrophilic material in this way the hydrophilic material and polyamide are more homogeneous distributed. This in turn was found to lead to slower leaching of the hydrophilic material and therefore to a longer lasting effect. In particular, cleaning particles prepared by cold fed extrusion provided their benefits (e.g. cleaning performance or DTI improvements) for a greater number of cleaning cycles.

To further improve the long-term effectiveness of the cleaning beads over many wash cycles it is preferable to use an extruder with a barrel length to diameter ratio of at least 5:1, more preferably at least 10:1, even more preferably at least 30:1 most preferably at least 40:1.

The extrusion process can be batch-wise or continuous.

The cleaning particles may comprise optional additives. Suitable optional additives include: stabilisers, lubricants, release agents, colorants and polymers other than thermoplastic polyamides.

The stabilisers can be thermal stabilisers (e.g. antioxidants) and/or UV stabilisers.

After preparation the cleaning particles can be dried by any suitable method including air, oven and fluidized bed drying.

The cleaning particles can comprise a defoaming agent. It is preferred that the cleaning particles only comprise relatively small amounts of defoaming agent. Preferably, the defoaming agent is present at from 0.001 to 5 wt %, more preferably from 0.001 to 3 wt % and especially from 0.01 to 2 wt %. The presence of a defoaming agent is particularly advantageous when the hydrophilic material is or comprises one or more surfactants (especially anionic surfactants).

Detergent Composition

The cleaning composition preferably also comprises iii. a detergent composition.

The detergent composition may comprise any one or more of the following components: surfactants, dye transfer inhibitors, builders, enzymes, metal chelating agents, biocides, solvents, stabilizers, acids, bases and buffers.

The detergent composition can be free of the hydrophilic material present in the cleaning particle. The detergent composition can be free of any surfactant when the hydrophilic material is a surfactant, it can be free of any DTI when the hydrophilic material is a DTI or it can be free of any builder when the hydrophilic material is a builder. If not completely free of these materials the detergent composition can comprise less than 1 wt %, more preferably less than 0.5 wt % and especially less than 0.1 wt % of these materials.

Slowing Depletion of the Hydrophilic Material

The method of the present invention preferably uses a cleaning composition which comprises a detergent wherein the detergent comprises the same hydrophilic material as is present in the cleaning particles, which is advantageous in slowing or minimising any depletion of the hydrophilic material from the cleaning particles after multiple wash cycles. Thus, when the hydrophilic material is a surfactant the detergent suitably comprises a surfactant, when the hydrophilic material is a DTI the detergent suitably comprises a DTI and when the hydrophilic material is a builder the detergent suitably comprises a builder. Thus for example, a detergent comprising sodium dodecyl benzene sulfonate (SDBS) can be used in combination with cleaning particles comprising SDBS. Equally, a detergent comprising a polymer comprising polyvinyl pyrrolidone repeat units is preferably used in combination with cleaning particles comprising a polymer comprising polyvinyl pyrrolidone repeat units.

Method

The cleaning method of the present invention agitates the substrate in the presence of the cleaning composition. The agitation may be in the form of shaking, stirring, jetting and tumbling. Of these tumbling is especially preferred. Preferably, the substrate and the cleaning composition are placed into a rotatable cleaning chamber which is rotated so as to cause tumbling. The rotation can be such as to provide a centripetal force of from 0.05 to 1 G and especially from 0.05 to 0.7 G. When the cleaning method is performed in a cleaning apparatus comprising a cleaning chamber which is a drum the centripetal force is preferably as calculated at the interior walls of the drum furthest away from the axis of rotation.

The agitation may be continuous or intermittent. Preferably, the method is performed for a period of from 1 minute to 10 hours, more preferably from 5 minutes to 3 hours and even more preferably from 10 minutes to 2 hours.

Preferably the cleaning particles are able to contact the substrate, more preferably the cleaning particles are able to mix with the substrate during the agitation. That said, advantageous washing results can also be obtained even when the cleaning particles are not able to mix and/or to contact the substrate. Thus, the method according to the first aspect of the present invention may be performed wherein the cleaning particles are or are not retained in a container preferably which permits the entry and exit of the liquid medium but which does not permit entry and exit of the cleaning particles. The container may be flexible or rigid. A preferred flexible container is a mesh bag having holes which are smaller than the average size of the cleaning particles. Preferably, the container has holes with a size of no more than 4 mm, more preferably no more than 3 mm, even more preferably no more than 2 mm and especially no more than 1 mm. The holes in the container are preferably at least 0.01 mm. By the use of such containers it is possible to perform the method of the present invention even using conventional washing apparatus. The container prevents the cleaning particles from adversely interacting with any of the components of the conventional washing machine. When using a container the textile substrate is preferably also added inside the container along with the cleaning particles. This permits the preferred contact and mixing of the substrate and cleaning particles.

The method according to the first aspect of the present invention is preferably performed at a temperature of from 5 to 95° C., more preferably from 10 to 90° C., even more preferably from 15 to 70° C., and advantageously from 15 to 50° C., 15 to 40° C. or 15 to 30° C. Such milder temperatures allow the cleaning particles used in the method of the present invention to provide the benefits (such as for example improved cleaning performance or colour fade inhibition) over larger numbers of cleaning cycles. Preferably, when several washloads are cleaned every cleaning cycle is performed at no more than a temperature of 95° C., more preferably at no more than 90° C., even more preferably at no more than 80° C., especially at no more than 70° C., more especially at no more than 60° C. and most especially at no more than 50° C. These lower temperatures again allow the cleaning particles to provide the benefits for a larger number of wash cycles.

The method is preferably a laundry cleaning method.

The method according to the first aspect of the present invention may additionally comprise one or more of the steps including: separating the cleaning particles from the cleaned substrate; rinsing the cleaned substrate; removing the substrate and drying the cleaned substrate.

Preferably, the cleaning particles are re-used in further cleaning procedures according to the first aspect of the present invention. In order of increasing preference, the cleaning particles can be re-used for at least 2, at least 3, at least 5, at least 10, at least 20, at least 50, at least 100, at least 200, at least 300, at least 400 and at least 500 cleaning procedures according to the first aspect of the present invention.

It will be appreciated that the duration and temperature conditions described hereinabove are associated with the cleaning of an individual washload comprising at least one of said substrate(s). The cleaning of an individual washload typically comprises the steps of agitating the washload with said cleaning composition in a cleaning apparatus for a cleaning cycle. A cleaning cycle typically comprises one or more discrete cleaning step(s) and optionally one or more post-cleaning treatment step(s), optionally one or more rinsing step(s), optionally one or more step(s) of separating the cleaning particles from the cleaned washload, optionally one or more drying step(s) and optionally the step of removing the cleaned washload from the cleaning apparatus. It will be appreciated that the agitation of the washload with said cleaning composition suitably takes place in said one or more discrete cleaning step(s) of the aforementioned cleaning cycle. Thus, the duration and temperature conditions described hereinabove are preferably associated with the step of agitating the washload comprising at least one of said substrate(s) with the cleaning composition, i.e. said one or more discrete cleaning step(s) of the aforementioned cleaning cycle.

It is preferred that the method of the present invention additionally comprises: separating the cleaning particles from cleaned substrate. Preferably, the cleaned particles are stored in a particle storage tank for use in the next cleaning procedure.

The method according to the first aspect of the present invention may comprise the additional step of rinsing the cleaned substrate. Rinsing is preferably performed by adding a rinsing liquid medium to the clean substrate. The rinsing liquid medium preferably is or comprises water. Optional post-cleaning additives which may be present in the rinsing liquid medium include optical brightening agents, fragrances and fabric softeners.

Apparatus

According to a second aspect of the present invention there is provided an apparatus suitable for performing the method according to the first aspect of the present invention comprising a rotatable cleaning chamber and a particle storage tank containing the cleaning particles as defined in the first aspect of the present invention.

The rotatable cleaning chamber is preferably a drum which is preferably provided with perforations which allow the cleaning particles to pass through the drum.

The apparatus preferably additionally comprises a pump for transferring the cleaning particles into the cleaning chamber.

The preferred apparatus according to the second aspect of the present invention is as described in WO2011/098815 wherein the second lower chamber contains the cleaning particles as defined in the first aspect of the present invention.

Use

According to a third aspect of the present invention there is also provided the use of the cleaning particles as defined in the first aspect of the present invention for cleaning a substrate which is or comprises a textile.

General

In the present invention the words "a" and "an" mean one or more. Thus, by way of examples a textile means one or more textiles, equally a thermoplastic polyamide means one or more thermoplastic polyamides and a hydrophilic material means one or more hydrophilic materials.

EXAMPLES

The invention will now be further illustrated, though without in any way limiting the scope thereof, by reference to the following examples.

1. Materials

The following materials were used to prepare the thermoplastic polyamide cleaning particles comprising hydrophilic materials:

Ultramid® B40 is a thermoplastic polyamide (Nylon-6) obtained from BASF SE having a viscosity number of 250 ml/g.

Ultramid® A34 is a thermoplastic polyamide (Nylon-6,6) obtained from BASF SE having a viscosity number of 190-220 ml/g.

The viscosity numbers were measured according to DIN ISO307 in all cases. The solvent is preferably 96% sulphuric acid.

The filler is an inorganic mineral filler.

SDBS is a surfactant which is sodium dodecyl benzene sulfonate.

Sokalan® HP56 is a dye transfer inhibitor from BASF, it is a copolymer obtained by polymerising vinyl pyrrolidone and vinyl imidazole.

Kollidon® K30 acts as a dye transfer inhibitor, it is obtained from BASF and is a polymer comprising polyvinyl pyrrolidone.

Pebax® MH1657 is a polyether block polyamide from Arkema, and is used herein as a dye transfer inhibitor.

Sokalan® CP5 acts a builder, it is obtained from BASF and is a copolymer of maleic acid and acrylic acid which is partially neutralised with sodium hydroxide.

2. Cleaning Particle Compositions and Extrusion Conditions

Tables 1a and 1b: Components used to prepare the cleaning particles.

TABLE 1a

| Component | Example 1 (SDBS) | Example 2 (HP56) | Example 3 (K30) | Example 4 (Pebax) | Example 5 CP5 | Comparative Example 1 |
|---|---|---|---|---|---|---|
| Reference | UFO28A_13/01 | GMO951_12/3 | UFO52_13/9A | GMO951_12/6 | UFO52_13/5 | UFO52_13/2 |
| Ultramid ® B40 | 57 | 42 | 57 | 25 | — | 65 |
| Ultramid ® A34 | — | — | — | — | 60 | — |
| Filler | 35 | 50 | 35 | 50 | 32 | 35 |
| SDBS | 8 | — | — | — | — | — |
| Sokalan ® HP56 | — | 8 | — | — | — | — |
| Kollidon ® K30 | — | — | 8 | — | — | — |
| Pebax ® MH1657 | — | — | — | 25 | — | — |
| Sokalan ® CP5 | — | — | — | — | 8 | — |
| Extrusion conditions | ES = 203<br>M = 50<br>Tmelt = 310<br>Tw = 25 | ES = 200<br>M = 60<br>Tmelt = 307<br>Tw = 65 | ES = 300<br>M = 100<br>Tmelt = 346<br>Tw = 65 | ES = 200<br>M = 100<br>Tmelt = 272<br>Tw = 65 | ES = 300<br>M = 20<br>Tmelt = 326<br>Tw = 65 | ES = 200<br>M = 60<br>Tmelt = 323<br>Tw = 40 |
| Feeding Zone of hydrophilic material in extrusion | 5 | 5 | 5 | 5 | 5 | — |
| Average cleaning particle size (mm) | 3.56 | 4.14 | 4.07 | 4.83 | 3.70 | — |

TABLE 1b

| Component | Example 6 (HP56) | Example 7 (SDBS) | Comparative Example 2 | Example 8 (HP56) | Example 9 (HP56) |
|---|---|---|---|---|---|
| Reference | GMO951 22/13 | GMO951_12/14 | GMO951 22/15 | GMO951 16/12 | GMO951 24/4 |
| Ultramid ® B40 | 48 | 48 | 55 | 28 | 53 |
| Ultramid ® A34 | — | — | — | — | — |
| Filler | 50 | 50 | 45 | 70 | 45 |
| SDBS | — | 2 | — | — | — |
| Sokalan ® HP56 | 2 | — | — | 2 | 2 |
| Extrusion conditions | ES = 252<br>M = 120<br>Tmelt = 286<br>Tw = 90 | ES = 250<br>M = 150<br>Tmelt = 285<br>Tw = 89 | ES = 200<br>M = 100<br>Tmelt = 323<br>Tw = 89 | ES = 200<br>M = 100<br>Tmelt = 288<br>Tw = 70 | ES = 252<br>M = 150<br>Tmelt = 280<br>Tw = 90 |
| Feeding Zone of hydrophilic material in extrusion | 1 | 1 | — | 4 | 1 |
| Average cleaning particle size | 4.45 | 4.78 | 4.32 | 4.59 | 6.78 |

ES—Extruder speed in rpm; M—Throughput in Kg/hour; Tmelt—Temperature of the melt at the die in ° C. and Tw—water temperature in ° C.

The components as tabulated in Table 1a and 1b were mixed and extruded using a twin-screw extruder at a melt temperature of from 270 to 350° C. The extruder had 9 feeding zones in total. The filler was metered in using a side feed with a gravimetric metering balance. The twin-screw extruder was used to extrude the melt into a cutting chamber containing water as the liquid coolant. The cutting speeds and extrusion pressures were adjusted to obtain the desired average cleaning particle size of around 4 mm or around 6 mm (measured as described herein). The extrusion method was as described in WO2004/080679 in Example 1. The conditions used for the extrusion process were as indicated in Table 1a and 1b.

3. Cleaning Tests—Cleaning Performance

Cleaning performance tests were performed for the following cleaning particles: Comparative Example 1, Example 1—SDBS and Example 5—CP5.

The cleaning tests were triplicated for each cleaning particle using a Xeros washing apparatus as described in PCT patent publication WO 2011/098815 with a recommended dry laundry loading of 25 kg. The washing cycle was carried out using 20 kgs of a cotton textile flatware ballast. The washing cycle was run for 60 minutes at a temperature of 20° C. using 250 gms of Pack 1 cleaning formulation supplied by Xeros Ltd. 69 $m^2$ of surface area of cleaning particles were used in all cases. The liquid medium was water. The cleaning particles were recycled through the cleaning apparatus during the washing cycle for 10 minutes of the washing cycle.

After each cleaning cycle the wash load was rinsed and the washing apparatus performed a separation cycle for a period of 30 minutes (both rinse and separation cycles).

To test the cleaning performance 5×WFK (Ref No PCMS-55 05-05×05) textile stain test sheets obtained from WFK Testgewebe GmbH were used for each type of cleaning particle in each of the triplicated cleaning experiments. Following each wash test the stain sheets were removed and dried by hanging at room temperature The L*, a*, b* values of each stain were measured before and after cleaning using a Konica Minolta CM-3600A spectrophotometer. For stain sheets obtained with each type of cleaning particle the average delta E value was calculated according to CIE76.

TABLE 2

Cleaning results for Example 1 and Comparative Example 1

| Cleaning Particles | Av delta E | Av delta E | Av delta E | Av delta E | Av delta E | Av delta E | Av delta E |
|---|---|---|---|---|---|---|---|
| Stain type | AL | GD | B | A | P | S | OG |
| Comparative Example 1 | 15.34 | 12.10 | 22.63 | 11.92 | 26.82 | 12.98 | 9.66 |
| Example 1 - SDBS | 16.27 | 12.93 | 23.79 | 14.08 | 28.88 | 13.20 | 10.71 |

Av delta E—Average delta E; AL—All Stains; GD—General Detergency; B—Bleachable Stains; A—Amylase responsive stains; P—Protease responsive stains; S—Sebum; OG—Oil and Grease stains.

Higher average delta E values correspond to better cleaning.

As can be seen the cleaning results were markedly better when the method of the present invention was performed using the cleaning particles containing a surfactant such as SDBS.

TABLE 3

Cleaning results for Comparative Example 1 and Example 5 - CP5

| Cleaning Particles | Av delta E | Av delta E | Av delta E | Av delta E | Av delta E | Av delta E | Av delta E |
|---|---|---|---|---|---|---|---|
| Stain type | AL | GD | B | A | P | S | OG |
| Comparative Example 1 | 16.25 | 13.52 | 22.39 | 11.40 | 27.14 | 15.89 | 10.68 |
| Example 5 - CP5 | 17.66 | 13.68 | 26.60 | 16.58 | 32.71 | 12.72 | 9.87 |

Av delta E—Average delta E; AL—All Stains; GD—General Detergency; B—Bleachable Stains; A—Amylase responsive stains; P—Protease responsive stains; S—Sebum; OG—Oil and Grease stains.

As can be seen the cleaning results were superior when the method of the present invention was performed using the cleaning particles containing a builder such as Poly(Acrylic acid-co-Maleic Acid) in the form of Sokalan® CP5. The cleaning results were especially good for enzymatic stains such as amylase and protease.

4. Cleaning Tests—Dye Transfer Inhibition

Dye transfer inhibition performance tests were performed for the following cleaning particles: Comparative Example 1, Example 2—HP56, Example 3—K30 and Example 4—Pebax.

Dye transfer inhibition (DTI) tests were duplicated for each cleaning particle using a Beko 5 Kg domestic machine. 1 Kg of polyester textile ballast was used for each test. The ballast comprised polyester fabric squares measuring 25×25 cm. 2.8 $m^2$ surface area of cleaning particles was used in each case. Four 20×20 cm white cotton textile swatches were added to each test to determine the amount of vagrant dye deposited.

Dye donor textile materials were obtained from Swissatest Testmaterialien AG. Each dye donor material was cut into 20×20 mm squares. The dye type and number of squares used in each DTI test were as shown in table 4.

TABLE 4 dye donor materials

| Dye | Number of 20 × 20 cm squares used in each test |
|---|---|
| Direct Black 22 | 1 |
| Direct Blue 71 | 1 |
| Direct Red 83.1 | 1 |
| Direct Orange 39 | ½ |

The items for each wash load were placed in a net mesh bag. Cleaning particles were mixed thoroughly with the fabric materials. The mesh bag was washed in a Beko domestic washing machine using a 40° C. cotton cycle with 12.5 g of Xeros Pack I detergent and the spin speed set to 1200 rpm. At the end of the wash cycle, white cotton squares were recovered, dried by hanging at room temperature.

A Konica Minolta CM-3600A spectrophotometer was used to obtain values of L*, a* and b* of the white cotton swatches following each DTI test. For swatches obtained with each type of cleaning particle the average delta E value was calculated according to CIE76. White cotton swatches washed with no dye donor material were used as a control to calculate the deltaE for each DTI test.

TABLE 5

DTI Results

| Cleaning particles | Average delta E |
|---|---|
| No Cleaning particles | 11.19 |
| Comparative Example 1 | 6.95 |
| Example 3 - K30 | 4.46 |
| Example 4 - Pebax | 3.96 |
| Example 2 - HP56 | 0.46 |

Lower values for delta E values correspond to less dye having been deposited on the white cotton swatches from the dye donor material. These results showed that the cleaning particles containing hydrophilic dye transfer materials provided marked improvements in dye transfer inhibition.

5. Cleaning Tests—Dye Transfer Inhibition (Pebax and HP56)

Dye transfer inhibition performance tests were performed for the following cleaning particles: Comparative Example 2, Example 6—HP56 and Example 4—Pebax.

Dye transfer inhibition (DTI) tests were duplicated for each cleaning particle using a Beko 5 Kg domestic machine. 250 g of polyolefin textile ballast was used for each test. The ballast comprised polypropylene textile sheet cut into squares measuring approximately 20×20 cm. 1.4 $m^2$ surface area of cleaning particles (1.5 kg of particles) was used in each case. Four 20×20 cm white cotton textile swatches were added to each test to determine the amount of vagrant dye deposited.

Dye donor materials were obtained from Swissatest Testmaterialien AG. Each dye donor material was cut into 20×20 mm squares. The dye type and number of squares used in each DTI test were as shown in table 4. Each dye type was tested separately.

The ballast, swatches and one of the dye donor materials for each wash load were placed in a net mesh bag. Cleaning particles were mixed thoroughly with the contents of the mesh bag. The mesh bag was washed in a Beko 5 Kg domestic washing machine using a 40° C. cotton cycle with 12.5 g of Xeros Pack I detergent and the spin speed set to 1200 rpm. At the end of the wash cycle, white cotton textile swatches were recovered, dried by hanging at room temperature.

A Konica Minolta CM-3600A spectrophotometer was used to obtain values of L*, a* and b* of the white cotton swatches following each DTI test. For swatches obtained using each type of cleaning particle the average delta E value was calculated according to CIE76. White cotton swatches cleaned with no dye donor material were used as a control to calculate the DE for each DTI test.

TABLE 6

DTI Results

| Cleaning particles | Average delta E: Direct Black 22 | Average delta E: Direct Blue 71 | Average delta E: Direct Red 83.1 | Average delta E: Direct Orange 39 | Average delta E: all dyes |
|---|---|---|---|---|---|
| Comparative Example 2 | 2.04 | 3.10 | 6.26 | 10.00 | 21.4 |
| Example 6 HP56 | 1.63 | 0.94 | 2.10 | 11.91 | 16.58 |
| Example 4 Pebax | 1.99 | 2.66 | 8.07 | 7.57 | 20.29 |
| 50 wt %:50 wt % mix of Example 6 - HP56 and | 1.96 | 0.74 | 1.54 | 8.32 | 12.56 |

TABLE 6-continued

| DTI Results | | | | | |
|---|---|---|---|---|---|
| Cleaning particles | Average delta E: Direct Black 22 | Average delta E: Direct Blue 71 | Average delta E: Direct Red 83.1 | Average delta E: Direct Orange 39 | Average delta E: all dyes |
| Example 4 - Pebax | | | | | |

Lower values for delta E values correspond to less dye having been deposited on the white cotton swatches from the dye donor material and thus to better DTI performance. These results showed that the performance of cleaning particles containing different hydrophilic DTIs varies depending on the type of dye. HP56 in the cleaning particles of Example 6 is particularly effective as a DTI with textiles dyed with Direct Black 22, Direct Blue 71 or Direct Red 83.1. In contrast, Pebax in the cleaning particles of Example 4 is particularly effective as a DTI with textiles dyed with Direct Orange 39. By physically blending 50 wt % of the cleaning particles of Example 6 (HP56) and 50 wt % of the particles of Example 4 (Pebax), improvements in the DTI performance of textiles dyes with a broader range of dyes were observed. In addition, textiles dyed with Direct Blue 71 and Direct Red 83.1 showed better DTI performance with the 50:50 cleaning particle mixture than with each of the DTI containing cleaning particles in isolation. This showed that having cleaning particles with two or more different DTI is especially advantageous and synergistic.

6. DTI—Lifetime Test

Lifetime tests were performed for the following cleaning particles: Comparative Example 2 and Example 6—HP56.

DTI Tests were performed using a Xeros washing apparatus as described in PCT patent publication WO 2011/098815 with a recommended dry laundry loading of 25 kg. The washing cycle was carried out using 20 kgs of a cotton textile flatware ballast. The washing cycle was run for 60 minutes at a temperature of 40° C. using 250 gms of Pack 1 cleaning formulation supplied by Xeros Ltd. 69 $m^2$ of surface area of cleaning particles were used in all cases. The cleaning particles were Example 6—HP56 and Comparative Example 2 and were as manufactured, that is to say the cleaning particles had never been through a cleaning cycle (virgin). The liquid medium was water. The cleaning particles were recycled through the cleaning apparatus during the washing cycle for 20 minutes of the cleaning cycle.

After each cleaning cycle the wash load was rinsed and the washing apparatus performed a separation cycle for a period of 30 minutes (both rinse and separation cycles).

In addition to the ballast, the washload also contained: 5 white Whaley's cotton textile swatches for evaluating the DTI performance. Vagrant dye was supplied by means of new textile garments: xxl red fruit of the loom t-shirts, 2 pairs Primark jeans (1× ladies Black, 1× Men's Blue) and 2 Primark vest tops (1× orange and 1× Yellow).

5 cleaning cycles were performed. After each cleaning cycle the white cotton swatches were removed and dried in a Danube Tumble drier for 5 minutes at 75° C. and allowed to cool to room temperature. A Konica Minolta CM-3600A spectrophotometer was used to obtain values of L*, a* and b* of the white cotton swatches before they were returned to the machine for the next of the 5 cleaning cycles. For swatches from each type of cleaning particle the average delta E value was calculated according to CIE76.

After initial DTI performance testing beginning with virgin cleaning particles of Example 6—HP56, the particles were washed in many cycles to simulate prolonged usage.

The cleaning cycles were run for 45 minutes at a temperature of 20° C. using 100 gms of Pack 1 cleaning formulation supplied by Xeros Ltd. 69 $m^2$ of surface area of cleaning particles were used in all cases. The liquid medium was water. The cleaning particles were recycled through the cleaning apparatus during the washing cycle for 15 minutes of the washing cycle.

After each cleaning cycle the wash load was rinsed and the washing apparatus performed a separation cycle for a period of 25 minutes (both rinse and separation cycles).

This was repeated until the cleaning particles had been used for 500 cycles. The DTI performance test was then repeated.

TABLE 7

| Example 6 - HP56 lifetime test results | | | | | |
|---|---|---|---|---|---|
| | Delta E | | | | |
| Test | Cycle 1 | Cycle 2 | Cycle 3 | Cycle 4 | Cycle 5 |
| Comparative Example 2 | 2.53 | 3.15 | 3.32 | 4.06 | 4.54 |
| Example 6 - HP56 (Virgin) | 1.62 | 2.06 | 2.59 | 3.02 | 3.28 |
| Example 6 - HP56 (500 cycles) | 1.71 | 2.36 | 2.59 | 2.88 | 3.38 |
| Difference between Virgin Ex. 6 and 500-cycle Ex. 6 | +0.09 | +0.30 | 0.00 | −0.14 | +0.10 |

Lower values for delta E values correspond to less dye having been deposited on the white cotton swatches from the dye donor garments. These results showed that the cleaning particles of Example 6—HP56 provided marked improvements in dye transfer inhibition. The results showed only a small difference between the DTI performance of the cleaning particles of Example 6 (virgin) and Example 6 (after 500 cycles), i.e. the average difference in Delta E across the 5 cycles was only +0.07. Thus, the cleaning particles containing a DTI surprisingly retain desirable benefits over many cycles. It would have been expected that the hydrophilic material would simply be dissolved or lost from the cleaning particles after the first washing cycle and thus would not have been expected to provide benefit in subsequent wash cycles.

7. Cleaning Lifetime Test

Cleaning performance tests were performed for the following cleaning particles: Comparative Example 2, Example 7—SDBS.

Cleaning tests were performed using a Xeros washing apparatus as described in PCT patent publication WO 2011/098815 with a recommended dry laundry loading of 25 kg. The washing cycle was carried out using 20 kgs of a cotton textile flatware ballast. The washing cycle was run for 60 minutes at a temperature of 20° C. using 250 gms of Pack 1 cleaning formulation supplied by Xeros Ltd. 69 $m^2$ of surface area of cleaning particles were used in all cases. The cleaning particles of Example 7—SDBS and Comparative Example 2 were as manufactured, that is to say they had not previously been through any cleaning cycles. The liquid medium was water. The cleaning particles were recycled through the cleaning apparatus during the washing cycle for 15 minutes of the washing cycle.

After each cleaning cycle the wash load was rinsed and the washing apparatus performed a separation cycle for a period of 30 minutes (both rinse and separation cycles).

To test the cleaning performance 5×WFK (Ref No PCMS-55 05-05×05) textile stain test sheets obtained from WFK Testgewebe GmbH were used for each type of cleaning particle in each of the triplicated cleaning experiments. Following each wash test the stain sheets were removed and dried by hanging at room temperature The L*, a*, b* values of each stain were measured before and after cleaning using a Konica Minolta CM-3600A spectrophotometer. For stain sheets used with each type of cleaning particle the average delta E value was calculated according to CIE76.

After initial cleaning performance testing of virgin Example 7—SDBS the cleaning particles were used for repeated washing cycles.

The washing cycles were run for 45 minutes at a temperature of 20° C. using 100 gms of Pack 1 cleaning formulation supplied by Xeros Ltd. 69 $m^2$ of surface area of cleaning particles were used in all cases. The liquid medium was water. The cleaning particles were recycled through the cleaning apparatus during the washing cycle for 15 minutes of the washing cycle.

After each cleaning cycle the wash load was rinsed and the washing apparatus performed a separation cycle for a period of 25 minutes.

This was repeated until the cleaning particles had been used for 50 cycles. The cleaning performance test was then repeated.

TABLE 8

Example 7 - Cleaning lifetime test results

| | Cleaning Particles | | | |
|---|---|---|---|---|
| | Av. delta E | Av. delta E | Av. delta E | Av. delta E |
| | Stain type | | | |
| | AL | GD | S | OG |
| Comparative example - 2 | 17.95 | 14.21 | 16.33 | 12.40 |
| Example 7 - SDBS (Virgin) | 18.59 | 14.93 | 17.80 | 13.36 |
| Example 7 - SDBS (50 cycles) | 18.29 | 14.83 | 17.47 | 13.15 |

Av delta E—Average delta E; AL—All Stains; GD—General Detergency; S—Sebum; OG—Oil and Grease stains.

Higher average delta E values correspond to better cleaning performance.

As can be seen from Table 8, the cleaning results were markedly better when the method was performed using the cleaning particles containing a surfactant such as SDBS in both the virgin and used state. The results also demonstrate that, surprisingly, the cleaning particles retain their superior cleaning performance even after many wash cycles.

8. HP56 Extraction Tests

The cleaning particles prepared above containing Sokalan HP56 (Examples 6, 8 and 9) were weighed (W1) and extracted in a soxhlet extractor using distilled water as the extraction liquid at a temperature of 100° C. The cleaning particles in the examples 6, 8 and 9 initially contained 2 wt. % Sokalan HP 56. The extraction was continued for 5, 24 or 48 hours.

After the extraction the concentration (c) of Sokalan HP56 in the extract was determined by gel permeation chromatography with a refractive index detector. The GPC method was used as a quantitative method with the aid of a calibration using known concentrations of Sokalan HP 56 in water. The extracted weight of Sokalan HP 56 (W2) was calculated from the total amount of water extract (V) and the concentration derived from the quantitative GPC measurement described above. (W2=c×V)

The relative percentage of extracted material (HP56) in relation to the total initially incorporated HP56 was then calculated to be (W1−W2)W1×100/0.02. The relative percentage is such that 100% relative percent corresponds to a complete extraction of all the HP56 that was present in the initial cleaning particles.

TABLE 9

Relative percentage of extracted material from Examples 6, 8 and 9

| | Example 6 | Example 8 | Example 9 |
|---|---|---|---|
| Feeding zone | Zone 1 | Zone 4 | Zone 1 |
| average particle size (mm) | 4.45 | 4.59 | 6.78 |
| 5 hours | 1.01% | 2.98% | 0.20% |
| 24 hours | 2.31% | 4.51% | 0.70% |
| 48 hours | 2.41% | 5.26% | 0.85% |

It was clearly evidenced that the cleaning particles used in the method of the present invention prepared by a process wherein the hydrophilic material was fed in the earlier (cold) zone of the extruder showed a markedly slower release of the hydrophilic material (HP56) as compared to cleaning particles prepared by a process wherein the hydrophilic material was fed in the later (hot) zone. In addition, it was evidenced that cleaning particles of a larger average particle size e.g. 5-10 mm more slowly released the hydrophilic material as compared to cleaning particles having an average particle size of from 1 to just less than 5 mm. Whilst not being limited to any particular theory it is considered by the inventors that cold zone addition of the hydrophilic material leads to a more homogeneous inclusion of the hydrophilic material in the polyamide matrix. Diffusion of the hydrophilic material from a more homogeneous mixture is considered to be slower which results in a more prolonged effectiveness of the cleaning particles in the method according to the first aspect of the present invention. Also, diffusion of the hydrophilic material from a larger particle is considered to be slower when compared to a smaller particle because of the longer diffusion path, this results in a more prolonged effectiveness of the cleaning particles in the method according to the first aspect of the present invention.

The invention claimed is:

1. A method for cleaning a substrate which consists of or comprises a textile, the method comprising agitating the substrate and a cleaning composition comprising:

i. cleaning particles comprising a thermoplastic polyamide and a hydrophilic material dissolved or dispersed within the thermoplastic polyamide throughout the volume of the particles, said cleaning particles having an average particle size of from 1 to 20 mm; and ii. an aqueous liquid medium, wherein the cleaning particles are not degradable and are insoluble in water;

wherein the cleaning particles retain the hydrophilic material after the agitating;

wherein the hydrophilic material consists of or comprises a surfactant, a dye transfer inhibitor (DTI) or a builder, or wherein the hydrophilic material consists of or comprises a polyether;

wherein the hydrophilic material is present in an amount of from 0.1 to 15 wt % based on a total weight of the cleaning particle; and wherein the thermoplastic polyamide consists of or comprises nylon 6, nylon 6,6, nylon 6,10 or a copolymer or blend thereof.

2. A method according to claim 1 wherein the hydrophilic material consists of or comprises a surfactant.

3. A method according to claim 2 wherein the surfactant is an anionic surfactant.

4. A method according to claim 3 wherein the anionic surfactant comprises one or more groups selected from the group consisting of sulfonate, sulfate and a combination thereof.

5. A method according to claim 4 wherein the anionic surfactant is dodecyl benzene sulfonate.

6. A method according to claim 1 wherein the hydrophilic material consists of or comprises a dye transfer inhibitor (DTI).

7. A method according to claim 6 wherein the DTI consists of or comprises a polymer.

8. A method according to claim 7 wherein the polymer comprises one or more repeat units obtained by polymerizing vinyl pyrrolidone.

9. A method according to claim 8 wherein the polymer comprises repeat units obtained by copolymerizing vinyl pyrrolidone and vinyl imidazole.

10. A method according to claim 1 wherein the hydrophilic material consists of or comprises a builder.

11. A method according to claim 10 wherein the builder consists of or comprises a polymer having carboxylic acid groups or salts thereof.

12. A method according to claim 11 wherein the builder consists of or comprises a polymer comprising repeat units obtained from polymerizing one or more of the monomers selected from the group consisting of maleic acid, acrylic acid, methacrylic acid, ethacrylic acid, vinylacetic acid, allylacetic acid, itaconic acid, 2-carboxy ethyl acrylate and crotonic acid which may be in the form of the free acid or salt thereof.

13. A method according to claim 12 wherein the builder consists of or comprises a polymer comprising the repeat units obtained by polymerizing one or more of the monomers selected from the group consisting of acrylic acid, methacrylic acid, and maleic acid which may be in the form of the free acid or salt thereof.

14. A method according to claim 13 wherein the builder consists of or comprises a copolymer of maleic acid-co-acrylic acid which may be in the form of the free acid or salt thereof.

15. A method according to claim 1 wherein the hydrophilic material consists of or comprises a polyether.

16. A method according to claim 15 wherein the polyether consists of or comprises polyether block polyamide.

17. A method according to claim 1 wherein the cleaning particles comprise a filler.

18. A method according to claim 1 wherein the cleaning particles have an average density of at least 1.3 g/cm$^3$.

19. A method according to claim 1 wherein the substrate is a soiled substrate.

20. A method according to claim 1 wherein the cleaning particles have an average particle size of from 1 to 10 mm.

21. A method according to claim 20 wherein the cleaning particles have an average particle size of from 5 to 10 mm.

22. A method according to claim 1 wherein the cleaning particles have a shape selected from the group consisting of ellipsoidal, spherical, cylindrical and cuboid.

23. A method according to claim 1 wherein the cleaning particles are re-used in further procedures according to the method.

24. A method according to claim 23 wherein the cleaning particles are re-used for at least 10 cleaning procedures according to the method.

25. A method according to claim 1 wherein the cleaning particles are prepared by a process which comprises extrusion using an extruder with a barrel length to diameter ratio of at least 5:1.

26. A method according to claim 1 wherein the cleaning particles comprise substantially no phase-separated domains of the hydrophilic material having any linear dimension which is larger than 1 mm.

27. A method according to claim 1, wherein said method further comprises the steps of (a) recovering said cleaning particles; (b) agitating a second washload comprising at least one substrate and a cleaning composition comprising the cleaning particles recovered from step (a), wherein said substrate consists of or comprises a textile; and (c) optionally repeating steps (a) and (b) for subsequent washload(s) comprising at least one substrate which consists of or comprises a textile.

28. A method according to claim 1 which is performed at a temperature of from 15 to 50° C.

* * * * *